US007013886B2

(12) United States Patent
Deng

(10) Patent No.: US 7,013,886 B2
(45) Date of Patent: Mar. 21, 2006

(54) PLASTIC SHELL HEATER

(76) Inventor: David Deng, 2668 Highridge Dr., Chino Hills, CA (US) 91709

( * ) Notice: Subject to any disclaimer, the term of this patent is extended or adjusted under 35 U.S.C. 154(b) by 0 days.

(21) Appl. No.: 10/746,103

(22) Filed: Dec. 26, 2003

(65) Prior Publication Data

US 2005/0139206 A1 Jun. 30, 2005

(51) Int. Cl.
*F24C 3/00* (2006.01)
*F24C 15/00* (2006.01)

(52) U.S. Cl. ..... 126/85 R; 126/83; 126/99 D

(58) Field of Classification Search ..... 129/92 C, 129/92 AC, 86, 83, 92 B, 99 C, 99 D, 110 B; 126/512

See application file for complete search history.

(56) References Cited

U.S. PATENT DOCUMENTS

| | | | | |
|---|---|---|---|---|
| 1,051,072 A * | 1/1913 | Bradley | ..... | 126/86 |
| 1,867,110 A * | 7/1932 | Signore | ..... | 126/92 AC |
| 2,160,264 A * | 5/1939 | Furlong | ..... | 126/90 R |
| 4,474,166 A * | 10/1984 | Shaftner et al. | ..... | 126/96 |
| 5,278,936 A * | 1/1994 | Shao | ..... | 392/365 |
| 6,340,298 B1 * | 1/2002 | Vandrak et al. | ..... | 126/91 R |

* cited by examiner

*Primary Examiner*—Josiah C. Cocks
(74) *Attorney, Agent, or Firm*—Trojan Law Offices

(57) ABSTRACT

A plastic shell heater utilizing multiple deflectors and vents at the top of interior of a portable heater to direct the heat away from the surface of the heater. This dramatically lowers the temperature of the external surfaces of the heater and allows the use of plastic as the material for the shell of the heater and also allows the use of heat sensitive electronic control panel for the heater.

5 Claims, 2 Drawing Sheets

PLASTIC SHELL HEATER

BACKGROUND-FIELD OF INVENTION

The present invention relates generally to a portable heater. More specifically, the present invention relates to a portable heater that has a plastic shell.

BACKGROUND-DESCRIPTION OF RELATED ART

Portable heaters are often used to heat a home. Generally a portable heater has a metallic shell. The metallic shell may be painted or may have patterns or designs printed on it. Due to the generally irregular shaped surfaces of a heater, the cost to mass produce the metallic shell is very high. Furthermore, the surface treatments such as painting and printing are often damaged during handling which further increases the cost of manufacturing. Plastic is a desirable material for use as shells for heaters. However, due to the low heat resistant of plastic and the high temperature generated in a heater, this has not been practical.

SUMMARY OF THE INVENTION

The present invention is a plastic shell heater that can be mass produced economically and quickly. The plastic shell heater utilizes multiple deflectors and vents at the top of interior of a portable heater to direct the heat away from the surface of the heater. This dramatically lowers the temperature of the external surfaces of the heater and allows the use of plastic as the material for the shell of the heater and also allows the use of heat sensitive electronic control panel for the heater.

DETAILED DESCRIPTION OF THE PREFERRED EMBODIMENT

Figure 1:
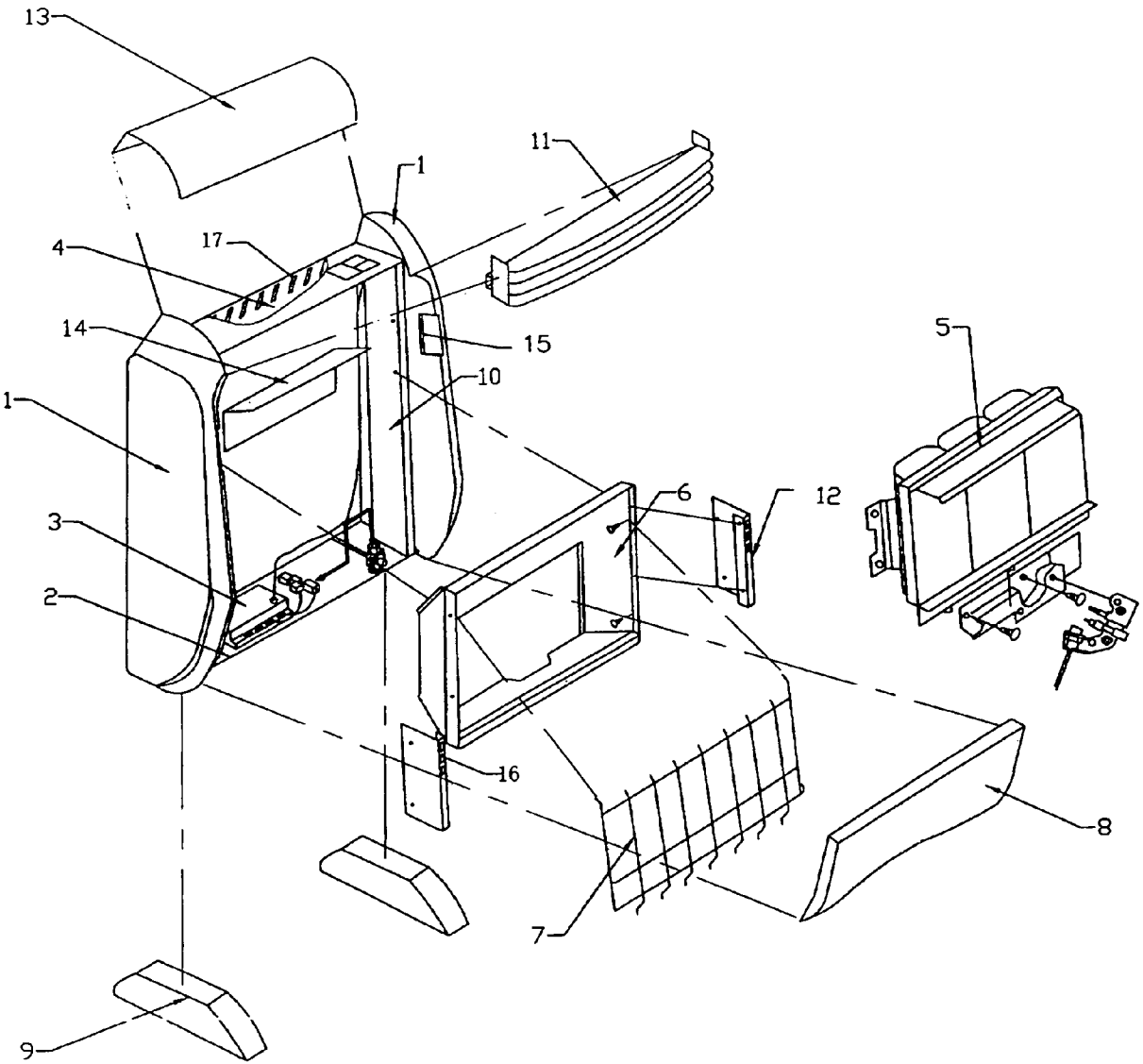
FIG. 1 shows an exploded view of the plastic shell heater.

FIG. 1 shows an exploded view of the preferred embodiment of the plastic shell heater. The plastic shell heater comprises of a left and a right panel 1 affixed to the left and right side of a rear panel 2 that has a vertical surface with multiple openings 17 near the top and a substantially horizontal surface at it bottom defining an interior space. A control system 3 is affixed to the bottom of the rear panel 2. A support panel 10 is affixed to each of the left and right panels 1 in the interior space. A left and a right spacer 12 with multiple openings 16 provided near the top edge of the spacers 12 are affixed to the support panel 10. A pair of stands 9 is affixed to the bottom of the plastic shell to allow the heater to stand upright. The heat source 5 is affixed to the rear panel 2 within the interior space. A control panel 4 is affixed near the top of the rear panel 2 and supported by the support panels 10. A grill 7 is affixed to a deflector frame 6 which is affixed to the support panels 10 and positioned around the heat source 5. A bottom panel 8 is affixed to the substantially horizontal surface of the rear panel 2. An operable top cover 13 is provided to cover the control panel 4.

A heat deflector 14 is affixed to the rear panel 2 above the hear source 5 to deflect the heat from the heat source 5 away from the top rear of the control panel 4. An assembly of heat deflector 11 comprising multiple heat deflecting fins are affixed above the deflector frame 6 to the support panels 10. In the preferred embodiment, the assembly of heat deflectors 11 comprises of 3 heat deflecting fins.

Figure 3:
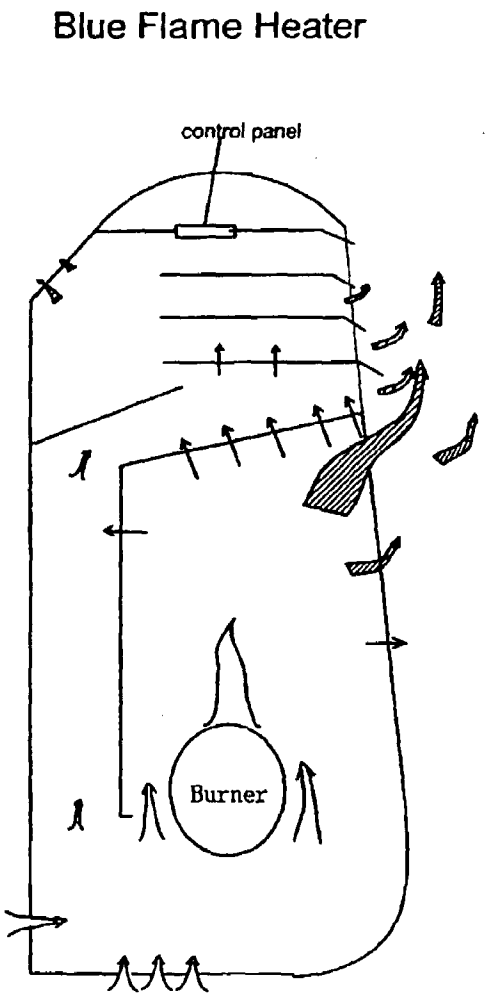
FIG. 3 shows a side view of a plastic shell heater using a blue flame burner as the heat source.
Figure 2:
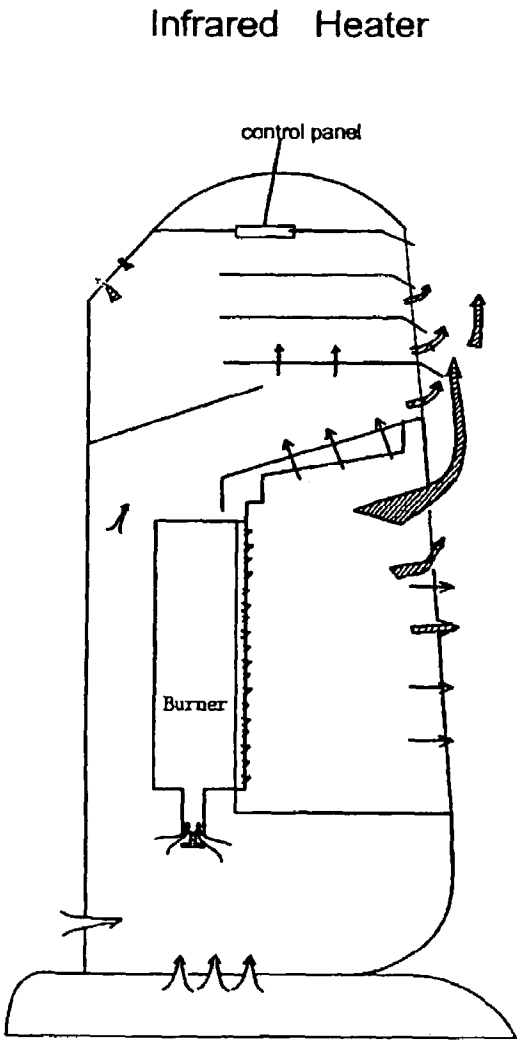
FIG. 2 shows a side view of a plastic shell heater using an infrared heater as the heat source.

As shown in FIGS. 3 and 4, the heat deflector 14 and the assembly of heat deflector 11 will direct the heat from the heat source 5 away from the top of the heater, allowing the use of heat sensitive electronic control panels 4 and plastic components such as a plastic top cover. The spacers 12 with the openings 16 allow the use of plastic side panels 1. The bottom panel 8 may also be made of plastic.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A plastic shell heater comprising:

a rear panel with a vertical surface with multiple openings near the top and a substantially horizontal surface at the bottom;

a left panel affixed to the left side of said rear panel;

a right panel affixed to the right side of said rear panel;

a control system affixed to the bottom of said rear panel;

a left support panel affixed to said left panel;

a right support panel affixed to said right panel;

a left spacer with multiple openings provided near the top edge of said spacer affixed to said left support panel;

a right spacer with multiple openings provided near the top edge of said spacer affixed to said right support panel;

a heat source disposed in front of said rear panel;

a control panel affixed near the top of said rear panel and supported by said support panels;

a grill affixed to a deflector frame which is affixed to said support panels and disposed around said heat source;

a bottom panel affixed to the substantially horizontal surface of said rear panel an operable top cover operably affixed above the control panel and covering the control panel;

a heat deflector affixed to said rear panel above said heat source;

an assembly of heat deflectors comprising multiple heat deflecting fins affixed above said deflector frame to said support panels.

2. A plastic shell heater as in claim 1, wherein said left side panel, said right side panel, said top cover, and said bottom panel are made of plastic.

3. A plastic shell heater as in claim 1, wherein said control panel is an electronic control panel.

4. A plastic shell heater as in claim 1, wherein a pair of stands is affixed to the substantially horizontal surface at the bottom of the rear panel.

5. A plastic shell heater as in claim 1, wherein said assembly of heat deflectors comprises three heat deflecting fins.

* * * * *